United States Patent [19]

Kazumoto et al.

[11] Patent Number: 4,856,283

[45] Date of Patent: Aug. 15, 1989

[54] REFRIGERATOR

[75] Inventors: Yoshio Kazumoto; Yoshiro Furuishi; Kazuo Kashiwamura, all of Hyogo, Japan

[73] Assignee: Mitsubishi Denki Kabushiki Kaisha, Tokyo, Japan

[21] Appl. No.: 168,078

[22] Filed: Mar. 14, 1988

[30] Foreign Application Priority Data

Mar. 13, 1987 [JP] Japan ..... 62-58153

[51] Int. Cl.[4] ..... F25B 9/00

[52] U.S. Cl. ..... 62/6; 60/520; 62/296; 92/85 A

[58] Field of Search ..... 62/6, 296; 60/520; 92/85 R, 85 A

[56] References Cited

U.S. PATENT DOCUMENTS 4,501,120 2/1985 Holland ..... 62/6

4,539,818 9/1985 Holland ..... 62/6

4,642,995 2/1987 Bachler et al. ..... 62/6

OTHER PUBLICATIONS

"Pneumatically Driven Split Cycle Cryogenic Refrigerator", Advances in Cryogenic Eng., vol. 19, pp. 216–220, 1973.

*Primary Examiner*—Ronald C. Capossela

*Attorney, Agent, or Firm*—Sughrue, Mion, Zinn, Macpeak and Seas

[57] ABSTRACT

A cold finger portion of a refrigerator is coupled to a movable member by means of a spring member having a linear characteristics to form a vibration system make phase difference between pressure variation and movement of the movable member and amplitude thereof possible to set at optimum values and to make a center of movement of the movable member constant by the linearity of the spring member regardless of operating condition.

1 Claim, 5 Drawing Sheets

REFRIGERATOR

BACKGROUND OF THE INVENTION

The present invention relates to a refrigerator such as a split Stirling type refrigerator in which a movable member is driven reciprocally by a pressure difference between opposite ends of the movable member.

FIGS. 7(A) to 7(D) show an operation of a conventional refrigerator such as disclosed in Japanese Patent Application Laid-Open No. 73873/1982. This refrigerator includes a reciprocal compressor 1 and a cold finger portion 2. A piston 3 of the compressor 1 serves to pressurize coolant gas such as helium to cause a pressure variation in sinusoidal form. A pressure variation in a compression chamber or space 4 is transmitted through a supply tube 5 into the cold finger portion 2. A cylindrical movable member 7 reciprocates freely in a housing 6 of the cold finger portion 2 to change volumes of a hot chamber or space 8 and a cold chamber or space 9 of the cold finger portion 2. The movable member 7 includes a regenerative type heat exchanger 10. The heat exchanger 10 is in the form of cylinder constituted with a stack of several hundreds of metal screen discs of fine mesh. Other heat exchanger such as formed by a pile of balls may be used instead thereof. Helium flows freely between the hot space 8 and the cold space 9 through the heat exchanger 10. A piston member 11 which is integral with the movable member 7 extends into a gas spring chamber or space 12 formed at an end of the hot space 8.

As shown, the refrigerator includes a pair of pressurized gas chambers or spaces separated from each other. Gas portions in the compression space 4 of the compressor 1, the supply pipe 5, the hot space 8, the cold space 9 and the heat exchanger 10 form a working chamber or space. Another gas chamber or space is formed by the gas spring space 12. The gas spring space 12 is sealed with respect to the working space by a piston seal 13 surrounding the piston member 11. A seal 14 is provided on the movable member 7 so that gas portion moving between the hot space 8 and the cold space 9 is forced to pass through the heat exchanger 10. A seal 15 is provided on the piston 3 to seal between the working space filled with gas and a buffer chamber or space in which a crank mechanism (not shown) is housed.

In operation, a lower end of the movable member 7 is in the cold space 9 of the cold finger portion 2 in a cycle shown in FIG. 7(A) and the compressor 1 is compressing gas in the working space. The compressing operation of the piston 3 of the compressor 1 causes gas pressure in the working space to increase from a minimum pressure to a maximum pressure. In this case, pressure in the spring space 12 is in a stable level between a minimum and a maximum pressures. Thus, pressure in the working space which is increasing at a certain time produces a pressure difference across the piston member 11 which is large enough to overcome frictional resistance given by the seals 14 and 13. Therefore, the piston member 11 and the movable member 7 are raised rapidly to positions shown in FIG. 7(B). Upon this movement of the movable member 7, high pressure gas in the hot space 8 at substantially environment temperature is forcibly introduced through the heat exchanger 10 into the cold space 9. The heat exchanger 10 absorbs heat of this pressurized gas passing therethrough to cool it. Therefore, with the sinusoidal driving by the crank mechanism, not shown, the piston 3 of the compressor starts to expand the working space as shown in FIG. 7(C), upon which high pressure helium gas in the cold space 9 is further cooled. This cooling in the cold space 9 provides a cooling effect large enough to produce a temperature gradient of 200° K. or more along the full length of the heat exchanger 10. At a certain time during the expansion movement of the piston 3, pressure in the working space is lowered below the pressure of the spring space 12 and a pressure difference therebetween acts to the piston member 11 to an extent enough to overcome friction force caused by the seals. Therefore, the movable member 7 is driven downwardly to a position shown in FIG. 7(D). The position in FIG. 7(D) is a start position prior to the position shown in FIG. 7(A). In this state, cooled gas in the cold space 9 passes through the heat exchanger 10 to cool it, i.e., to be heated thereby, and gas heated to substantially environment temperature is returned to the hot space 8.

As is clear from the foregoing description, in order to increase the efficiency of refrigerator, the upward movement of the movable member 7 should be delayed until the piston 3 of the compressor reaches an end point of its stroke as shown in Figs. 7(A) and 7(B). Similarly, the downward movement of the movable member 7 should be delayed until the piston 3 reaches the other end of its stroke as shown in FIGS. 7(C) and 7(D). This is because cooling effect of expansion and heating effect of compression are maximum and minimum at these points, respectively. Japanese Patent Application Laid-Open No. 265459/1986 discloses an improvement of the conventional refrigerator mentioned above. However, in both of the conventional refrigerator, a phase relation between pressure in the working space and movement of the movable member is determined by only frictional force applied by the seals to the movable member, pressure loss of the heat exchanger 10, spring constant of the gas spring in the gas spring space 12 and mass of the movable member 7. Therefore, it is very difficult to obtain an optimum phase difference and to increase the efficiency of refrigerator. Further, due to non-linearity of gas spring, a center position of vibration of the movable member is influenced largely by a small change of operating condition, so that the movable member may collide the housing wall, causing the performance thereof unstable.

SUMMARY OF THE INVENTION

An object of the present invention is to provide a refrigerator which has a high efficiency and is highly reliable.

According to the present invention, a cold finger portion of a refrigerator is coupled vibratingly to a movable member by a spring member.

Since, in the present invention, the spring member and the movable member constitute a vibration system, it is possible to set a phase difference between pressure variation of a working space and a movement of the movable member at an optimum value by changing a spring constant of the spring member. In addition, since the spring member has a linear characteristics within a resiliency range, there is no shift of vibration center due to change of operating condition.

DETAILED DESCRIPTION OF THE PREFERRED EMBODIMENTS

Figure 1D:
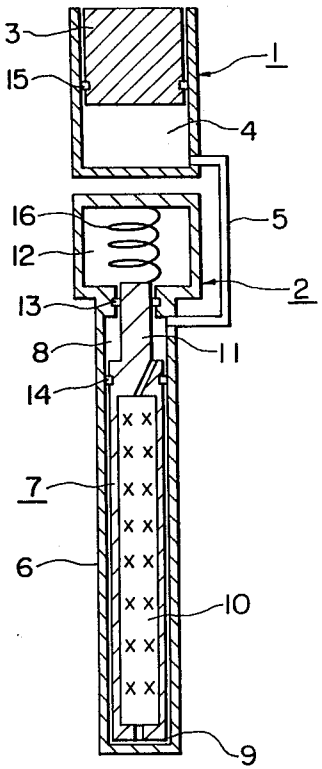
FIGS. 1(A) to 1(D) show an operation of an embodiment of the present invention.
Figure 1C:
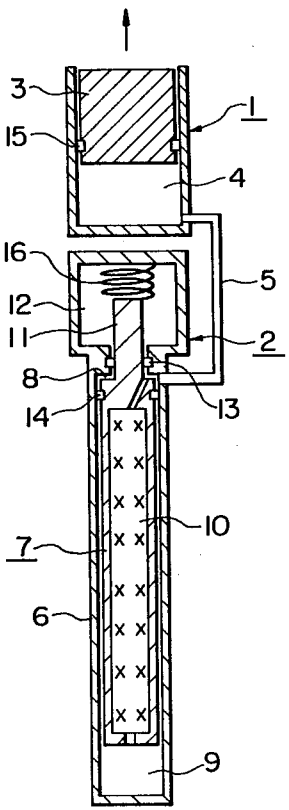
Figure 1B:
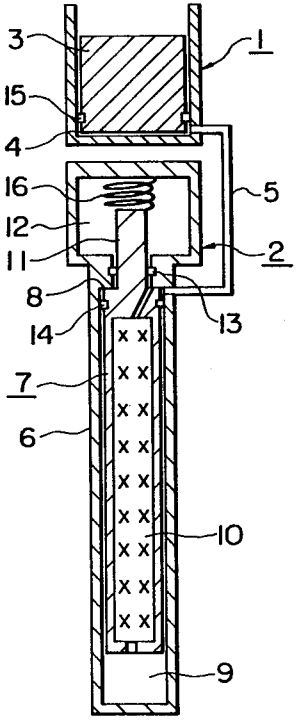
Figure 1A:
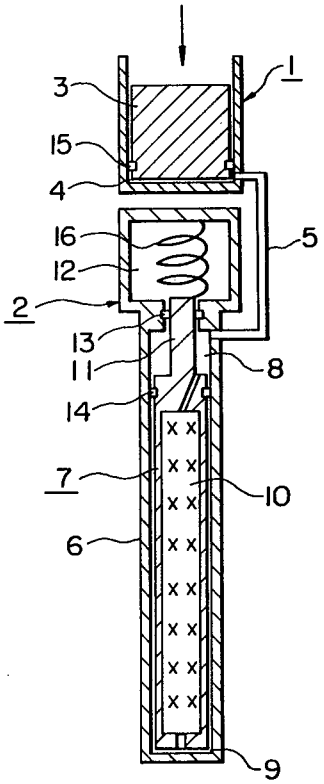

An embodiment of the present invention will be described with reference to the accompanying drawings.

In FIGS. 1(A) to 1(D), reference numerals 1 to 15 depict the same components as those shown by same reference numerals in FIGS. 7(A) to 7(D), respectively. In FIGS. 1(A) to 1(D), a spring member 16 which may be in the form of a coil spring has a lower end fixed to a top end surface of a piston member 11 of a movable member 7 and an upper end fixed to an upper wall of a gas spring chamber or space 12, so that the movable member 7 is vibrated by an external driving force.

Figure 2A:
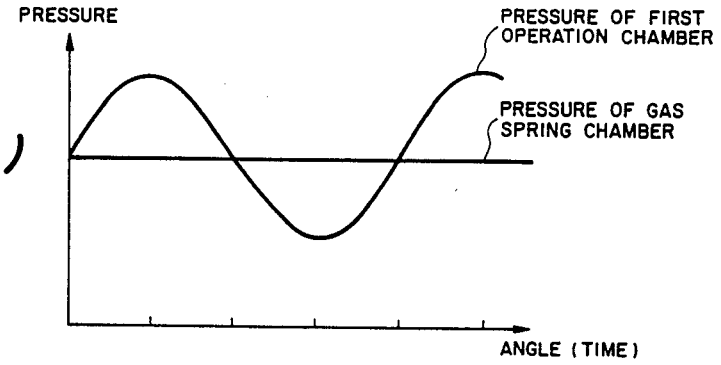
FIGS. 2*a* to 2*c* are characteristics curves of operation of the embodiment in FIG. 1.
Figure 2B:
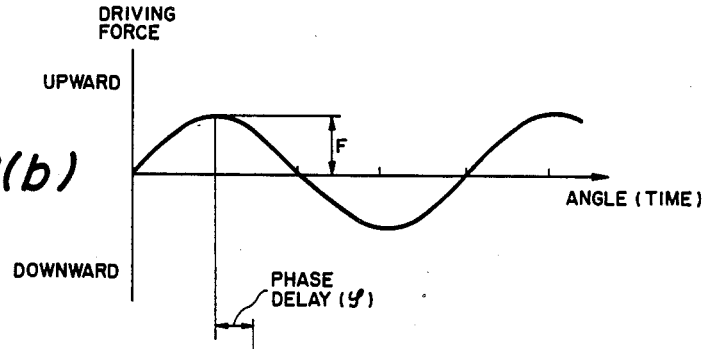
Figure 2C:
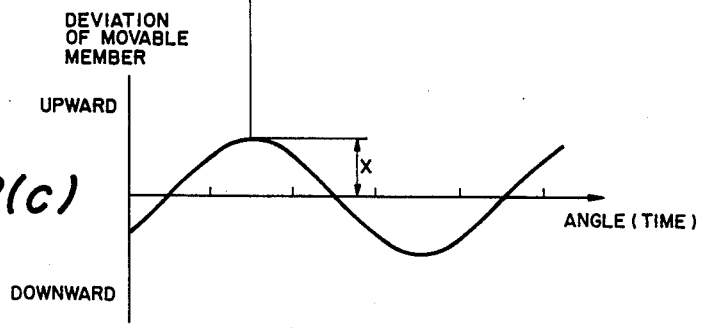

An operation of this embodiment will be described with reference to FIGS. 1 to 4 inclusive. As mentioned in the description of the conventional refrigerator, a vertical movement of sinusoidal curve of a piston 3 causes a sinusoidal pressure variation of a working chamber or space composed of gas portions in a compression chamber or space 4, a supply tube 5, a hot chamber or space 8, a cold chamber or space 9 and a heat exchanger 10, as shown in FIG. 2*a*. In this case, since pressure in the gas spring space 12 is maintained at an average pressure in the working space substantially, a driving force shown in FIG. 2*b* which is a product of a pressure difference between the working space and the gas spring space 12 and a cross sectional area of the piston member 11 is exerted on the movable member 7. Since the movable member 7 and the spring member 16 constitute a vibration system, the movable member 7 vibrates as shown in FIG. 2*c* by this driving force. Phase delay $\psi$ with respect to the vibrating force and an amplitude X of vibration can be determined according to the following equations by using mass m of the movable member 7, spring constant k of the spring member 16, amplitude F of vibrating force and friction resistance coefficient C of seals 13 and 14 for the piston member and the movable member.

$$\psi = \tan^{-1}\left\{\frac{2(\omega/\omega n)(C/Cc)}{1-(\omega/\omega n)^{-2}}\right\}$$

$$X = \frac{F/k}{\sqrt{\{1-(\omega^2/\omega n^2)\}^2 + \{2(\omega/\omega n)(C/Cc)\}^2}}$$

where $\omega$ is angular frequency of driving force and $\omega$ and Cc are given as $$\omega n = \sqrt{\frac{k}{m}} \quad Cc = 2\sqrt{m \cdot k}$$

Figure 3A:
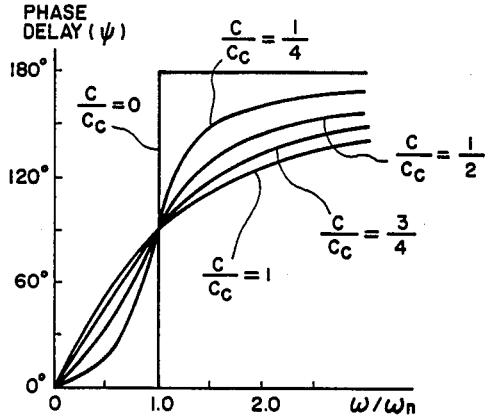
FIGS. 3*a* and 3*b* are response curves of a vibration system ( phase delay and magnitude ratio ) upon external vibration force.
Figure 3B:
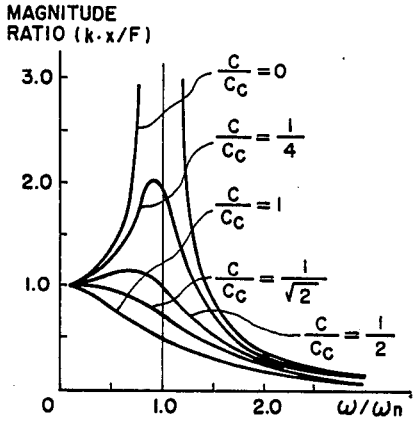

FIGS. 3*a* and 3*b* show frequency ratio ($\omega/\omega_n$) dependencies of phase delay ($\psi$) and amplification ratio (k·X/F). As is clear from FIGS. 3*a* and 3*b*, phase delay $\psi$ can take a value from 0° to 180° with variation of ($\omega/\omega_n$), i.e., variation of k and/or m, and amplification ratio (k·X/F) can take a value from 0 to $\infty$ with the same variation of ($\omega/\omega_n$) Therefore, by changing mass m of the movable member 7 and constant k of the spring member 16, it is possible to change phase delay and amplitude arbitrarily within the ranges, respectively, and to thereby obtain phase and amplitude which are optimum for performance of the refrigerator.

Figure 4A:
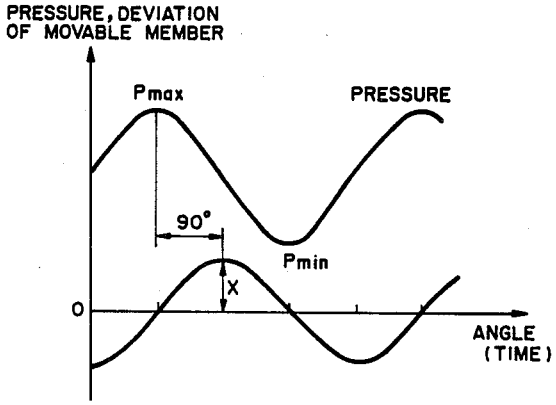
FIGS. 4*a* and 4*b* are pressure vs. volume curves.
Figure 4B:
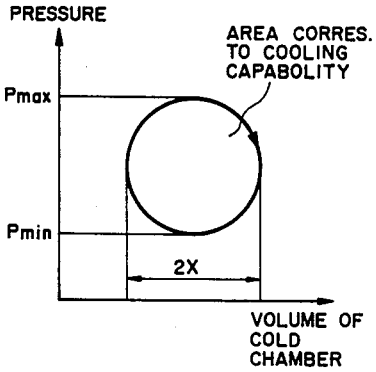

FIG. 4*a* shows an example of a relation between pressure variation of the working space and movement of the movable member 7. In this case, pressure vs. volume chart of the cold space 9 becomes circular as shown in FIG. 4*b* and maximum cooling effect is obtained because an area of circle is maximum among Lissajous's figures for same amplitude.

Figure 5:
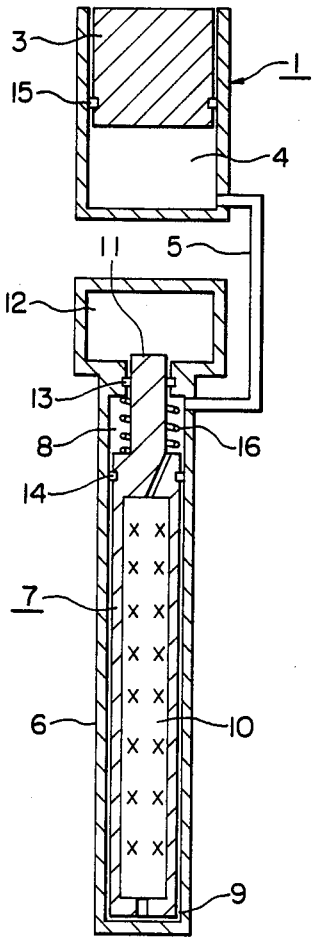
FIGS. 5 and 6 are cross sections of other embodiments of the present invention, respectively.
Figure 6:
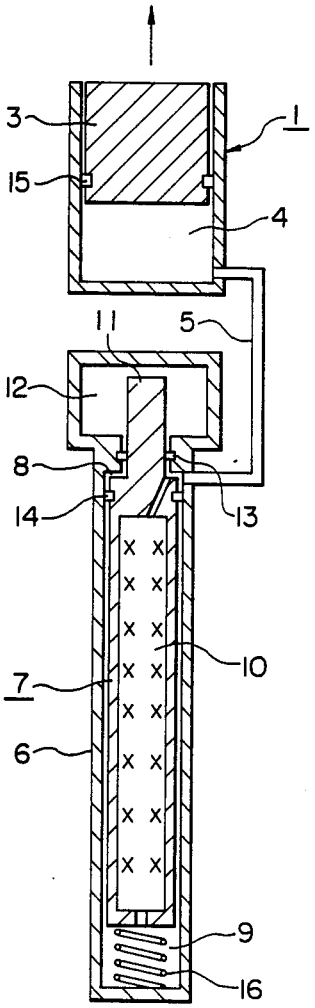
Figure 7D:
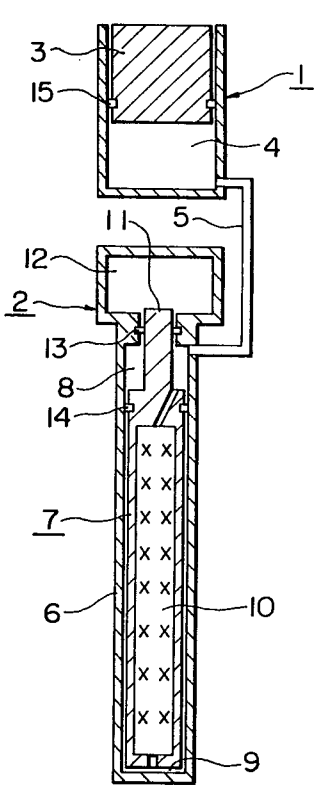
FIG. 7(D) PRIOR ART
FIGS. 7(A) to 7(D) are cross sections of a conventional refrigerator showing an operation thereof.
Figure 7C:
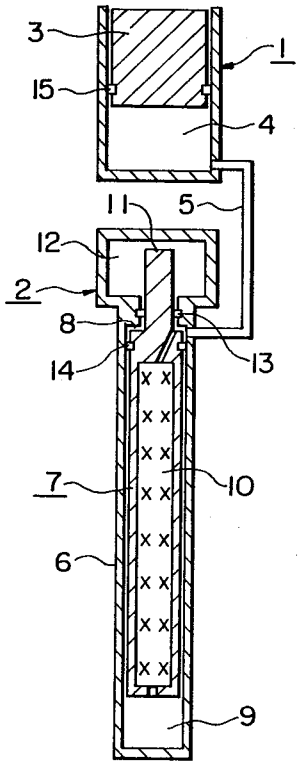
FIG. 7(C) PRIOR ART
Figure 7B:
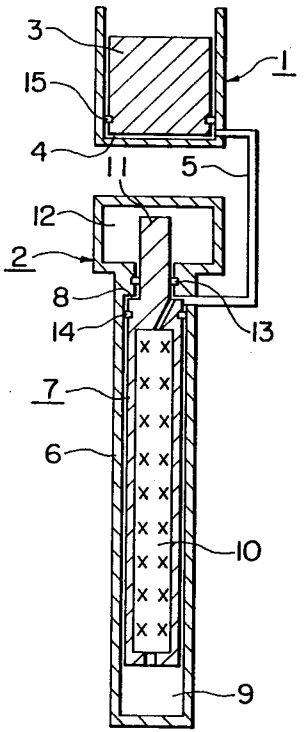
FIG. 7(B) PRIOR ART
Figure 7A:
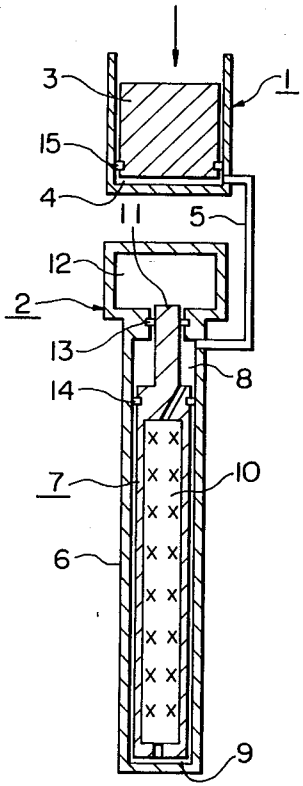
FIG. 7(A) PRIOR ART

The spring member 16 which constitutes the vibration system together with the movable member 7 is provided between the piston member 11 and the gas spring space 12 in this embodiment. However, it may be attached to the piston member 11 and provided in the hot space 8 as shown in FIG. 5 or may be provided on a lower end portion of the movable member 7, i.e., in the cold space 9 as shown in FIG. 6.

As described hereinbefore, according to the present invention, the cold finger portion is coupled to the movable member by means of the spring member to form the vibration system. Therefore, it is possible to select phase difference between pressure variation and movement of the movable member and amplitude thereof at optimum values, resulting in a highly efficient refrigerator. Further, since the center of movement of the movable member is made constant by the linearity of the spring member regardless of operating condition, collision of the movable member with the housing wall is avoided, resulting in a highly reliable, safe refrigerator.

What is claimed is:

1. A refrigerator apparatus, comprising: a compressor (1), a cold finger portion (2) defining a cylinder (6) connected through a supply pipe (5) to said compressor, a movable member (7) reciprocable within said cold finger portion cylinder, a regenerative heat exchanger (10) disposed within said movable member and in free communication with opposite outer ends thereof, a gas working space including a space (8) at one end of the cylinder, a closed end gas spring space (12) defined axially outwardly of said one end of the cylinder and separated from said gas working space by seal means (13) surrounding an axial extension (11) of said movable member projecting into said spring space, said movable member being adapted to be driven by a difference in pressure between said gas working space and said gas spring space with a phase relation between an operation pressure and movement of said movable member, and a spring member (16) disposed between and continuously coupling one end of said movable member and said cold finger portion and constituting, together with said movable member, a vibration system wherein said spring member is a coil spring having one end fixed to an upper end of said movable member.

* * * * *